US009524604B2

(12) United States Patent
Erb

(10) Patent No.: US 9,524,604 B2
(45) Date of Patent: Dec. 20, 2016

(54) HAND TOWEL DISPENSER HAVING MEANS FOR DATA CAPTURE AND TRANSMISSION

(75) Inventor: Markus Erb, Ebikon (CH)

(73) Assignee: CWS-Boco Supply AG, Baar (CH)

( * ) Notice: Subject to any disclaimer, the term of this patent is extended or adjusted under 35 U.S.C. 154(b) by 180 days.

(21) Appl. No.: 14/376,421

(22) PCT Filed: Feb. 3, 2012

(86) PCT No.: PCT/CH2012/000028

§ 371 (c)(1),
(2), (4) Date: Nov. 7, 2014

(87) PCT Pub. No.: WO2013/113129

PCT Pub. Date: Aug. 8, 2013

(65) Prior Publication Data

US 2015/0066207 A1 Mar. 5, 2015

(51) Int. Cl.

| | |
|---|---|
| ***A47K 10/28*** | (2006.01) |
| ***G07F 9/02*** | (2006.01) |
| *A47K 10/32* | (2006.01) |

(52) U.S. Cl.

CPC ..... *G07F 9/026* (2013.01); *A47K 10/28* (2013.01); *A47K 2010/3226* (2013.01); *Y10T 29/49716* (2015.01)

(58) Field of Classification Search

CPC ..... A47K 10/28; A47K 2010/3226
USPC ..... 700/236, 241, 244
See application file for complete search history.

(56) References Cited

U.S. PATENT DOCUMENTS

| | | | | |
|---|---|---|---|---|
| 6,267,460 | B1 * | 7/2001 | Gaide | A47K 10/28 312/34.11 |
| 6,360,181 | B1 * | 3/2002 | Gemmell | A47K 5/1202 705/22 |
| 6,411,920 | B1 * | 6/2002 | McConnell | A47K 10/42 242/564.1 |
| 7,783,380 | B2 * | 8/2010 | York | A47K 5/06 700/231 |

(Continued)

FOREIGN PATENT DOCUMENTS

| | | | |
|---|---|---|---|
| EP | 0940110 | A1 | 9/1999 |
| WO | 99/33008 | A2 | 7/1999 |
| WO | 2006/065515 | A2 | 6/2006 |

OTHER PUBLICATIONS

English Translation of the Preliminary Report on Patentability dated Aug. 14, 2014 in Corresponding International Patent Application No. PCT/CH2012/000028, Filed Feb. 3, 2012.

*Primary Examiner* — Timothy Waggoner
(74) *Attorney, Agent, or Firm* — Rankin, Hill & Clark LLP

(57) ABSTRACT

A hand towel dispenser capable of data capture and transmission. The hand towel dispenser includes a reel shell for holding a hand towel roll that includes fresh dispenser material, a rotatably held reel that takes up used dispenser material, a measuring apparatus for capturing measured values that represent the quantity of used dispenser material, and a radio module that is connected to the measuring apparatus to receive the measured values captured by the measuring apparatus. The radio module is designed to transmit radio signals, each of which contains at least one measured value. The measuring apparatus includes at least one first sensor for capturing the quantity of used dispenser material. And, the sensor is connected to the radio module.

32 Claims, 3 Drawing Sheets

(56) References Cited

U.S. PATENT DOCUMENTS

| | | | | |
|---|---|---|---|---|
| 7,996,108 | B2 * | 8/2011 | Yardley | B65H 35/0006 700/236 |
| 8,146,775 | B2 * | 4/2012 | De Jong | A47K 10/28 312/34.4 |
| 8,600,547 | B2 * | 12/2013 | Petersen | A47K 10/36 700/244 |
| 2003/0168549 | A1 | 9/2003 | Formon et al. | |
| 2007/0194166 | A1 | 8/2007 | Reinsel et al. | |

* cited by examiner

HAND TOWEL DISPENSER HAVING MEANS FOR DATA CAPTURE AND TRANSMISSION

BACKGROUND OF INVENTION

Field of Invention

The invention relates to a hand towel dispenser and means for data capture and transmission, to a device with a hand towel dispenser, to a kit for retrofitting a hand towel dispenser, to a method for monitoring and servicing a hand towel dispenser, and to a method for retrofitting a hand towel dispenser.

Description of Related Art

A device for capturing and transmitting data that concerns the individual consumption in the total consumption of washroom products is known from the document WO 99/33008 KIMBERLEY-CLARK. This known device comprises one or more product dispensers that are provided with a portion meter for the dispensed product. The dispensed portions are detected by a sensor integrated in the product dispenser. The data captured by the sensor is transmitted to a local data transmission unit that generates a data signal with a predetermined format from the data obtained from the sensor and transmits this data signal wirelessly to a central data capture unit at a distance from the product dispenser, wherein the data signal generated by the local data transmission unit represents at least the product consumption. The data signal transferred from the local data transmission unit to the central data capture unit is stored by the central data capture unit for later analysis. The use of several product dispensers can be monitored by a single central data capture unit. This known device has the disadvantage that no reusable dispenser material can be used and that the measuring device and the data capture device are arranged in such a manner that the retrofitting of an existing device without a measuring- and data transmission device can be achieved only with significant expense.

BRIEF SUMMARY OF THE INVENTION

The invention intends to help this situation. The invention has the basic task of creating a hand towel dispenser with reusable dispenser material and with a measuring- and data transmission device whose measuring- and data transmission device is constructed in a simple manner.

The invention solves the posed task with a hand towel dispenser, with a device with a hand towel dispenser, with a kit for retrofitting a hand towel dispenser, with a method for monitoring and servicing the hand towel dispenser and with a method for retrofitting a hand towel dispenser as disclosed herein and as claimed.

The advantages achieved by the invention are essentially that by virtue of the device in accordance with the invention an existing, commercial hand towel dispenser can be readily retrofitted with a reusable textile dispenser material by including the measuring- and data transmission device arranged in a radio module.

Other advantageous embodiments of the invention can be commented on as follows:

In a special embodiment the measuring device comprises a first signal-initiating element, preferably a first magnet, that can be fastened on a drive roller driving the reel roll.

In another embodiment the measuring device comprises a second sensor and a second signal-initiating element, preferably a second magnet, wherein the second signal-initiating element is fastened on a deflection shaft for the dispenser material to be dispensed. It can be determined by the second magnet arranged on the deflection shaft via the second sensor when a hand towel is rolled off from the fresh hand towel roll to be rolled off. Since it is determined by the measuring device when dispenser material is wound onto the reel roll reeling the used dispenser material, it can therefore be determined when only fresh hand towel is wound off and no used hand towel is wound off, i.e., a "floor loop" reaching the floor can be reported by a radio signal "dispenser not drawing in" to the service personnel. Furthermore, the number of dispenser events can be determined by the second sensor and the second magnet for statistical purposes.

In another embodiment the measuring device comprises a third sensor and a third signal-initiating element, preferably a third magnet, wherein the third signal-initiating element is stationarily fastened on the housing. The reel shell shifts against the housing roof when dispenser material is wound off from the fresh hand towel roll so that a third supply state "dispenser full" is captured by the measuring device when the reel shell is in its lower in position removed from the housing roof. Furthermore, the remaining supply of dispenser material is determined until a remaining supply of 80% has been reached by the measuring device when the reel shell shifts against the housing roof. In this manner the remaining supply determined by the first sensor and the first magnet can be checked and any error detected.

In another embodiment the radio module and the first sensor are fastened on the reel shell. As a result, the hand towel dispenser can be readily retrofitted by replacing the reel shell.

The second and/or the third sensor are also preferably arranged on the reel shell.

In yet another embodiment an indication of the supply can be determined by the measuring device with a first supply state "dispenser almost empty" given a residual supply of dispenser material of less than 25% and a second supply state "dispenser empty".

This can achieve the advantages that:

- the supply states "dispenser almost empty" and "dispenser empty" are readily detected in the hand towel dispenser and can be forwarded to the service personnel. The detection of these measured values and the transfer of data for "dispenser almost empty" and "dispenser empty" takes place in real time so that therefore an early warning system for the service personnel can be set up; and
- the using of the service personnel can be optimized by the detection and transmission of both supply states "dispenser almost empty" and "dispenser empty", so that the hand towel dispenser can be filled before the message "dispenser empty" takes place.

In another embodiment the first supply state "dispenser almost empty" indicates a remaining supply of dispenser material of less than 15%.

In another embodiment the radio module comprises a microcontroller with which the used amount of dispenser material can be determined from the measured values captured by the measuring device.

In another embodiment the hand towel dispenser comprises a protocol converter, preferably a gateway with which the data transmitted by the radio module is received and can be forwarded wirelessly to an external communication network. The data signals from several product dispensers distributed, e.g., in a floor of a building can be captured by the gateway and forwarded to an external network. The data signals forwarded in the external communication network can then be received by a central data processing system, stored and further processed.

The gateway preferably comprises a clock so that a forwarded radio signal also comprises, in addition to the at least one measured value, the time of its forwarding. The wirelessly transmitted protocols also comprise, in addition to the data for "dispenser almost empty" and "dispenser empty", the time at which the corresponding state was captured in the product dispenser and transmitted.

In yet another embodiment a level indication representing the current amount of used dispenser material is transmitted in a periodically transmitted radio signal by the radio module, wherein preferably four of these periodic radio signals are transmitted per hour. The total transmission time of the radio module can therefore be reduced.

In another embodiment the radio module transmits a periodic signal that indicates that the radio module is in operation. The periodic transmission of a signal, e.g., every 15 minutes, that indicates that the radio module is in operation (alive message) ensures that communication problems are rapidly recognized and can be eliminated and can also be used to transmit the indication of level and other measured values and data.

The radio module preferably transmits radio signals in a frequency range between 868 MHz and 870 MHz.

The transmission time of a radio signal of the radio module (2) is preferably between 55 ms and 65 ms, typically 60 ms.

In another embodiment the number of revolutions that the real roll that winds up the used dispenser material carries out can be captured by the measuring device.

In another embodiment a drive roller is fastened on the reel shell with which the used dispenser material can be wound on the reel axis of the reel roll.

In another embodiment the hand towel dispenser comprises drive means, preferably a spring storage drive with which the drive roller is driven.

In another embodiment a deflection roller is arranged on the housing and is driven during a winding off of dispenser material from the fresh hand towel roll and by which the spring storage drive can be pre-tensioned.

In yet another embodiment the drive means comprises a time-delay device that is activated during the winding off of dispenser material from the fresh hand towel roll and after the course of a set time span activates the drive means for drawing in the used dispenser material.

In another embodiment the drive roller forms with the reel roll comprising the used dispenser material a rotatable frictional contact or also called a non-positive connection.

The drive roller is preferably provided with nubs on its jacket surface, as a result of which an increase of the rotatable, non-positive connection between the drive roller and the reel roll can be achieved.

In another embodiment the hand towel dispenser comprises a signal amplifier or signal preparer, preferably a repeater, that is arranged between the radio module and the gateway. The repeater makes possible a data transfer between the product dispenser and the gateway over great distances.

In another embodiment the radio module comprises a battery and the loaded state of the battery is captured by the radio module and transmitted as another data signal.

In another embodiment the hand towel dispenser comprises a manual defect switch connected to the radio module so that upon actuation of the defect switch a message "dispenser defect" is transmitted by the radio module.

In another embodiment the radio signals that comprise the supply states "dispenser almost empty" and "dispenser empty" can be transmitted in real time by the radio module.

In another embodiment the radio signals transmitted by the radio module comprise an identification of the product dispenser.

The radio signals transmitted by the radio module preferably additionally comprise the location of the product dispenser.

The device in accordance with the invention comprises a central data processing system that is connected for the data transmission via an external communication network to the gateway. The data contained from the product dispensers can be stored in the central data processing system and further processed. Furthermore, communications concerning maintenance and service work to be performed can be transmitted from the central data processing system to maintenance companies.

In a special embodiment of the device the external communication network is a mobile telephone network and the data transmission from the gateway to the central data processing system takes place via the mobile telephone network. The mobile telephone network is preferably a standard network such as the GSM (Global System for Mobile Communication).

In a special embodiment the method comprises the further steps:

- Capture of the used amount of dispenser material on the winding-up reel roll by the measuring device;
- Forwarding of the captured, used amount of dispenser material in a periodically transmitted radio signal from the radio module to the gateway;
- Forwarding of this radio signal together with the indication of the time of the transmission from the gateway to the central data processing system;
- Storing the captured, used amount of dispenser material in a data memory of the central data processing system; and
- Processing the detected amounts of dispenser material with the particular indications of time with the central data processing system to data concerning the frequency of use and the product consumption of the hand towel dispenser.

BRIEF DESCRIPTION OF THE SEVERAL VIEWS OF THE DRAWINGS

The invention and further developments of the invention are explained in detail in the following using the partially schematic views of several exemplary embodiments.

In the drawings.

DETAILED DESCRIPTION OF THE INVENTION

Figure 1:
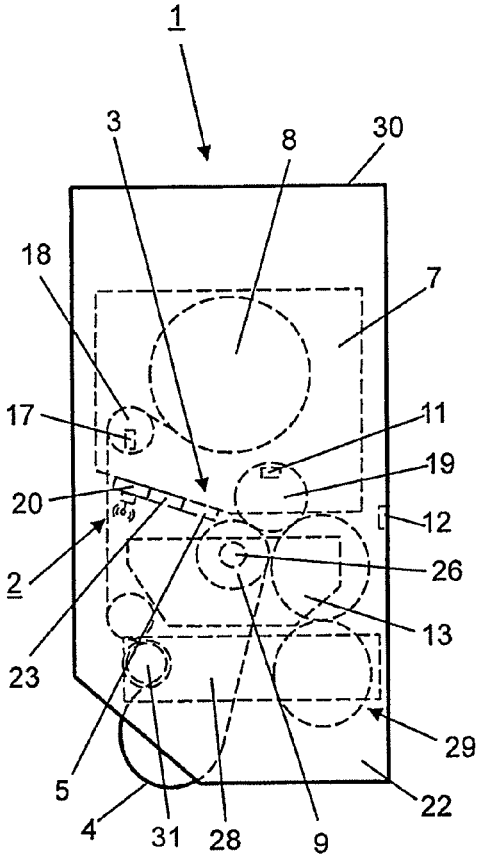
FIG. 1 shows a lateral view of an embodiment of the hand towel dispenser in accordance with the invention.
Figure 2:
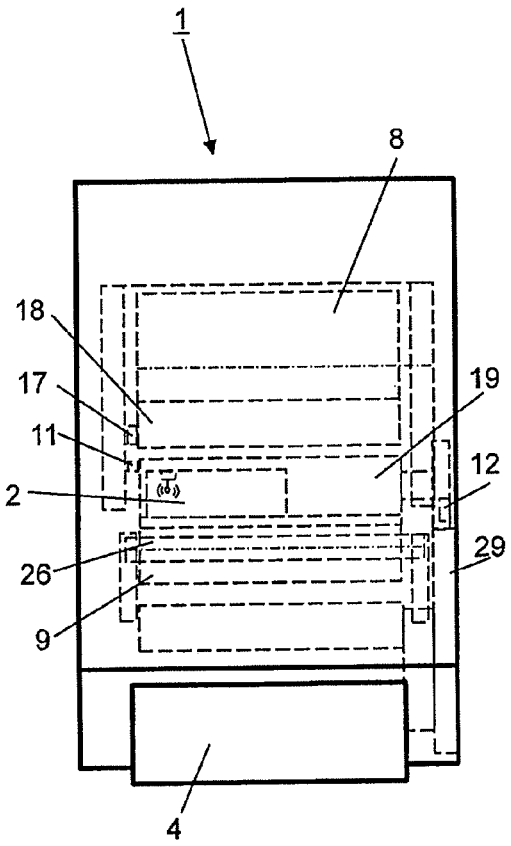
FIG. 2 shows a front view through the embodiment of the hand towel dispenser in accordance with the invention shoreline in FIG. 1.

The embodiment of the hand towel dispenser 1 in accordance with the invention for a reusable textile dispenser material 4 shown in FIGS. 1 and 2 substantially comprises a housing 22 comprising a reel shell 7 for receiving a hand towel roll 8 comprising the fresh dispenser material 4 and comprising a pivot module 13 for the rotatable reception of a reel roll 9 that winds up the used dispenser material 4, a measuring device 3 for capturing measured values that comprise the amount of used dispenser material 4 and a radio module 2 that is connected to the measuring device 3 for receiving the measured values captured by the measuring device 3, and is constructed for transmitting radio signals that each contain at least one measured value.

The amount of used dispenser material 4 on the reel roll 9 that winds up the used dispenser material 4 can be captured by the measuring device 3, wherein in addition an indication of the supply can be determined by the measuring device 3 with a first supply state "dispenser almost empty" at a remaining supply of dispenser material 4 of selectively between less than 25% and less than 15% and a second supply state "dispenser empty".

The hand towel dispenser 1 comprises a manual defect switch 24 connected to the radio module 2 so that upon actuation of the defect switch 24 by the radio module 2 a message "dispenser defect" is transmitted.

The radio module 2 is fastened on the reel shell 7 and serves to receive and transmit the measured values captured by the measuring device 3 in the form of data signals.

The number of executed dispenser events is transmitted in a periodically transmitted radio signal by the radio module 2, wherein in general four of these periodic radio signals are transmitted per hour. It can additionally be detected by the periodically transmitted radio signal that the radio module 2 is in operation. Furthermore, the radio module 2 comprises a battery whose loaded state is detected by the radio module 2 and transmitted as another data signal.

The radio module 2 comprises a microcontroller with which the used amount of dispenser material 4 can be determined from the measured values captured by the measuring device 3.

A level indication defining the amount of used dispenser material 4 is transmitted in a periodically transmitted radio signal by the radio module 2, wherein preferably four of these periodic radio signals are transmitted per hour. In addition, the radio module 2 sends a periodic signal that indicates that the radio module 2 is in operation. The data signals are transmitted by the radio module 2 with a frequency of 868 MHz, whereby the transmission time of a radio signal is 60 ms.

Furthermore, the radio signals transmitted by the radio module 2 contain an identification and/or the location of the hand towel dispenser 1.

The number of revolutions that the reel roll 9 that winds up the used dispenser material 4 executes can be can be captured by the measuring device 3. The measuring device 3 comprises a first sensor 5 and a first magnet 11, wherein the first magnet 11 is fastened on a drive roller 19 driving the reel roll 9, comprises a second sensor 20 and a second magnet 17, whereby the second magnet 17 is fastened on a deflection shaft 18 for the dispenser material 4 to be dispensed, and a third sensor 23 and a third magnet 12, whereby the third magnet 12 is stationarily fastened on the housing 22. The number of dispenser events can be determined by the second sensor 20 and the second magnet 17 that can be used for statistical purposes.

The reel shell 7 shifts against the housing roof 30 when dispenser material 4 is wound off from the fresh hand towel roll 8 so that a third supply state "dispenser full" can be captured by the measuring device 3 when the reel shell 7 is in its lower in position removed from the housing roof 30. Furthermore, the remaining supply of dispenser material is determined until a remaining supply of 80% has been reached by the measuring device when the reel shell 7 shifts against the housing roof 30. In this manner the remaining supply determined by the first sensor 5 and the first magnet 11 can be checked and any error detected. The second and third sensors 20; 23 are also connected to the radio module 2. The three sensors 5; 20; 23 are constructed as so-called Reed sensors for detecting a magnetic field. The three sensors 5; 20; 23 are constructed as so-called Reed sensors for detecting a magnetic field.

Furthermore, a drive roller 19 is fastened on the reel shell 7 with which the used dispenser material 4 can be wound on the reel axis 26 of the reel roll 9. The hand towel dispenser 1 comprises drive means constructed as a spring storage drive 28 with which the drive roller 19 is driven.

In addition, a deflection roller 31 is arranged on the housing 22 and is driven during a winding off of dispenser material 4 from the fresh hand towel roll 8 and by which the spring storage drive 28 can be pre-tensioned. A transmission 29 is arranged between the spring storage drive 28 and the drive roller 19.

The drive means comprises a time-delay device that is activated during the winding off of dispenser material 4 from the fresh hand towel roll 8 and after the course of a set time span activates the drive means for drawing in the used dispenser material 4.

The drive roller 19 forms with the reel roll 9 comprising the used dispenser material 4 a rotatable frictional contact that is improved in that the drive roller 19 is provided with nubs on its jacket surface.

Figure 3:
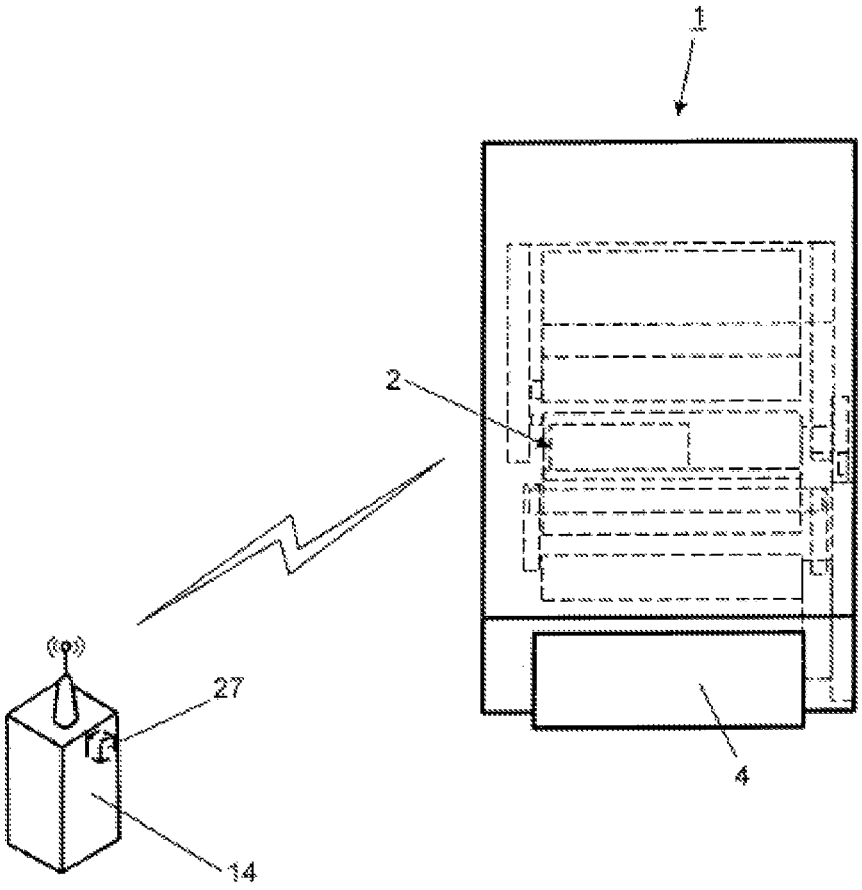
FIG. 3 shows a perspective view of another embodiment of the hand towel dispenser in accordance with the invention.

In the embodiment shown in FIG. 3 the hand towel dispenser 1 comprises a protocol converter, preferably a gateway 14 with which the data transmitted by the radio module 2 is received and can be forwarded further wirelessly to an external communication network 15. The gateway 14 comprises a clock 27 so that a forwarded radio signal also comprises, in addition to the measured value, the time of its forwarding.

The data signals transmitted by the radio module 2 are received by the gateway 14 and forwarded together with the indication of the time of the transmission wirelessly to an external communication network 15. The external communication network 15 is a mobile telephone network, e.g., a standard network such as the GSM (Global System for Mobile Communication).

Figure 4:
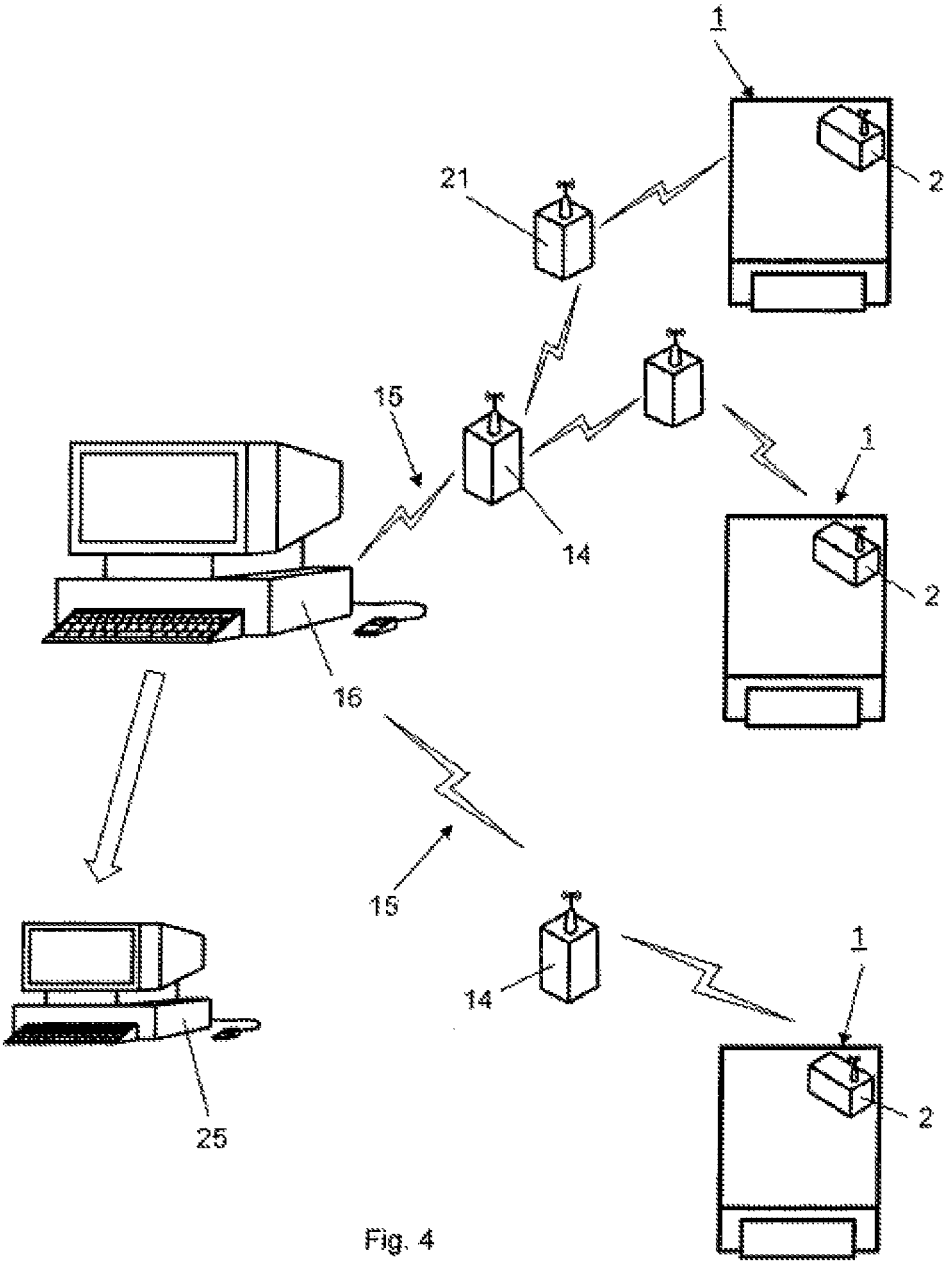
FIG. 4 again shows a perspective view of an embodiment of the device in accordance with the invention.

The embodiment of the device in accordance with the invention shown in FIG. 4 comprises several hand towel dispensers 1 and additionally a central data processing system 16 that is connected to the gateway 14 for data transmission via the external communication network 15. Furthermore, the device for those hand towel dispensers 1 that are arranged far from the gateway 14 comprises a signal amplifier or signal preparer, preferably a repeater 21, that is arranged between the corresponding radio module 2 and the corresponding gateway 14. The data from the central data processing system 16 is forwarded via a cable network, e.g., the Internet or wirelessly via a mobile telephone network to another data processing system 25 arranged, e.g., in a maintenance company. Alternatively or additionally, the data can also be transmitted from the central data processing system 16 via a mobile telephone network to a mobile telephone of the maintenance personnel.

The method for monitoring and servicing the device in accordance with the invention shown in FIG. 4 substantially comprises the steps: 1) Capturing the supply state "dispenser almost empty" or "dispenser empty" in at least one hand towel dispenser 1 by the measuring device 3; 2) Receiving the radio signal "dispenser almost empty" or "dispenser empty" transmitted from the radio module 2 in real time by the protocol converter, preferably by the gateway 14; and 3) Furthering the received radio signal "dispenser almost empty" or "dispenser empty" together with the indication of the time of the transmission via the gateway 14 by an external communication network 15 to a central data processing system 16.

Furthermore, the following steps can be carried out by the device:

Capture of the used amount of dispenser material 4 on the winding-up reel roll 9 by the measuring device 3;

Forwarding of the captured, used amount of dispenser material 4 in a periodically transmitted radio signal from the radio module 2 to the gateway 14;

Forwarding of this radio signal together with the indication of the time of the transmission from the gateway 14 to the central data processing system 16;

Storing the captured, used amount of dispenser material 4 in a data memory of the central data processing system 16; and Processing the detected amounts of dispenser material 4 with the particular indications of time with the central data processing system 16, e.g., to data concerning the frequency of use and the product consumption of the hand towel dispenser 1.

The data signals captured by the measuring device 3 and transmitted by the radio module 2 substantially comprise the following messages:

1) dispenser almost empty
2) dispenser empty
3) dispenser defective
4) dispenser not drawing any dispenser material in
5) portion meter
6) battery alive
7) battery almost empty.

Starting from the above-cited messages, the following real-time information and long-time reports can be obtained and prepared by the central data-processing system 16:

TABLE 1

| Dispenser almost empty | | |
|---|---|---|
| Information type | Report content | Shipment type/distribution type |
| Real-time info | "Dispenser almost empty" < 20%<br>clock time<br>cleaning team<br>building (No./name)<br>floor number/floor plan<br>room number<br>washroom type (men, women, handicapped)<br>dispenser identification number | SMS (cleaning personnel)<br>email<br>web portal<br>Status with traffic light system:<br>Green = dispenser OK<br>orange = "dispenser almost empty"<br>red = "dispenser empty" |
| Long-time report | Survey of "dispenser almost empty"<br>adjustable time span<br>adjustable survey of certain dispensers in certain areas/washrooms (grouping)<br>adjustable survey of certain dispensers associated with the cleaning personnel (by cell phone number, email address) | email<br>web portal (graphic, tables, diagrams, floor plans) |

TABLE 2

| dispenser empty | | |
|---|---|---|
| Information type | Report content | Shipment type/distribution type |
| Real-time info | "Dispenser empty" = 0%<br>clock time<br>cleaning team<br>building (No./name)<br>floor number/floor plan<br>room number<br>washroom type (men, women, handicapped)<br>dispenser identification number | SMS (cleaning personnel)<br>email<br>web portal<br>Status with traffic light system:<br>Green = dispenser OK<br>orange = "dispenser almost empty"<br>red = "dispenser empty" |
| Long-time report | Survey of "dispenser empty"<br>adjustable time span<br>adjustable survey of certain dispensers in certain areas/washrooms (grouping)<br>adjustable survey of certain dispensers associated with the cleaning personnel (by cell phone number, email address) | email<br>web portal (graphic, tables, diagrams, floor plans) |

TABLE 2-continued

| dispenser empty | | |
|---|---|---|
| Information type | Report content | Shipment type/distribution type |
| Long-time report | Reaction time of filling the dispenser<br>measuring the time span between info "dispenser empty" to stop of info (dispenser was refilled)<br>adjustable time span; also course of time over a certain time period<br>adjustable survey of certain dispensers in certain areas/washrooms (grouping)<br>adjustable survey of certain dispensers associated with the cleaning personnel (by cell phone number, email address) | email<br>web portal (graphic, tables, diagrams, floor plans) |

TABLE 3

| Information from the messages "dispenser almost empty" and "dispenser empty" | | |
|---|---|---|
| Information type | Report content | Shipment type/distribution type |
| Long-time report | Reaction time from "dispenser almost empty" to "dispenser empty"<br>measuring of the dispensers whose information jumps from "dispenser almost empty" to "dispenser empty".<br>adjustable time span; also course of time over a certain time period<br>adjustable survey of certain dispensers in certain areas/washrooms (grouping)<br>adjustable survey of certain dispensers associated with the cleaning personnel (by cell phone number, email address) | email<br>web portal (graphic, tables, diagrams, floor plans) |

TABLE 4

| Dispenser defect | | |
|---|---|---|
| Information type | Report content | Shipment type/distribution type |
| Real-time info | "Dispenser defect"<br>clock time<br>cleaning team<br>building (No./name)<br>floor number/floor plan<br>room number<br>washroom type (men, women, handicapped)<br>dispenser identification number | SMS (CWS service)<br>web portal<br>Status with traffic light system:<br>green = dispenser OK<br>red = "dispenser defect" |
| Long-time report | Survey of the "dispenser defect"<br>adjustable time span<br>adjustable survey of certain dispensers in certain areas/washrooms (grouping)<br>adjustable survey of certain dispensers associated with the CWS service (by cell phone number) | email<br>web portal (graphic, tables, diagrams, floor plans) |

TABLE 5

| Dispenser does not draw in | | |
|---|---|---|
| Information type | Report content | Shipment type/distribution type |
| Real-time info | "Dispenser does not draw in"<br>clock time<br>building (No./name)<br>floor number/floor plan<br>room number<br>washroom type (men, women, handicapped, | email and later SFDC.-case (CWS-service or FM partner) with possible re-confirmation to the client that info has been received (per |

TABLE 5-continued

| Dispenser does not draw in | | |
|---|---|---|
| Information type | Report content | Shipment type/distribution type |
| | kitchen, etc. + washroom for personnel)<br>dispenser identification number<br>FM-personnel can eliminate this defect or directly decide whether the message "dispenser service" is initiated. | SMS/email to FM partner)<br>web portal<br>Status with traffic light system:<br>Green = dispenser OK<br>red = "dispenser defect" |

TABLE 6

| Portion meter | | |
|---|---|---|
| Information type | Report content | Shipment type/distribution type |
| Long-time report | "Frequency of use" & "Roll use"<br>Measuring of the roll use by portion meters and Reset function during refilling of the roll<br>Adjustable survey for the real roll use of one or more dispensers<br>Adjustable survey for the average real roll use of one or more dispensers<br>Adjustable time span; also time course for a certain time period; comparison of time spans, Possibility on the basis of past values to indicate future trends of the roll use<br>Adjustable for a certain time of day (morning,<br>noon, evening, night); comparison of times of day possible<br>Adjustable survey of certain dispensers in certain areas/washrooms (grouping);<br>Comparison of dispensers, washrooms and buildings<br>Adjustable survey of certain dispensers associated with the cleaning personnel (by cell phone number, email address) | email<br>web portal (graphic, tables, diagrams, floor plans) |

TABLE 7

| Battery alive | | |
|---|---|---|
| Information type | Report content | Shipment type/distribution type |
| Real-time info | "Battery alive"<br>clock time<br>cleaning team<br>building (No./name)<br>floor number/floor plan<br>room number<br>washroom type (men, women, handicapped)<br>dispenser identification number | SMS (cleaning personnel)<br>email |

TABLE 8

| Battery almost empty | | |
|---|---|---|
| Information type | Report content | Shipment type/distribution type |
| Real-time info | "Battery almost empty"<br>clock time<br>cleaning team<br>building (No./name) | SMS (cleaning personnel)<br>email<br>web portal |

TABLE 8-continued

| Battery almost empty | | |
|---|---|---|
| Information type | Report content | Shipment type/distribution type |
| | floor number/floor plan<br>room number<br>washroom type (men, women, handicapped)<br>dispenser identification number | Status with traffic light system:<br>Green = battery OK<br>orange = "battery almost empty" |

Although different embodiments of the present invention were described above, they are to be understood in such a manner that the different features can be used individually as well as also in any desired combination in other embodiments. Furthermore, it is not intended to limit the protective scope of the present application to the special embodiments of the device and of the method presented in the specification.

The invention claimed is:

1. A hand towel dispenser comprising:

a reel shell for receiving a hand towel roll containing fresh dispenser material;

means for rotatably receiving a reel roll that winds up used dispenser material;

a measuring device comprising a first sensor and a second sensor, said measuring device being configured to capture measured values from the first sensor that represent an amount of used dispenser material wound up on the reel roll, capture measured values from the second sensor that represent an amount of fresh dispenser material dispensed from the hand towel roll, and determine when a "floor loop" condition has occurred based upon a comparison of measured values captured from the first sensor and the second sensor; and a radio module that is connected to the measuring device, said radio module being configured to receive the measured values captured by the measuring device and to transmit radio signals that contain at least one measured value;

wherein the measuring device comprises a first signal-initiating element fastened on a drive roller driving the reel roll, wherein the measuring device comprises a second signal-initiating element fastened on a deflection shaft for the hand towel roll containing fresh dispenser material, and wherein the radio module is configured to transmit a radio signal "dispenser not drawing in" when the measuring device determines that a "floor loop" condition has occurred.

2. The hand towel dispenser according to claim 1, wherein the measuring device comprises a third sensor and a third signal-initiating element, wherein the third signal-initiating element is stationarily fastened on a housing of the hand towel dispenser.

3. The hand towel dispenser according to claim 1, wherein the radio module and the first sensor are fastened on the reel shell.

4. The hand towel dispenser according to claim 1, wherein the second sensor and/or a third sensor is arranged on the reel shell.

5. The hand towel dispenser according to claim 1, wherein an indication of a supply of dispenser material as determined by the measuring device is transmitted, wherein a first supply state "dispenser almost empty" is transmitted when a remaining supply of dispenser material is less than 25%, and wherein a second supply state "dispenser empty" is transmitted when the residual supply of dispenser material is depleted.

6. The hand towel dispenser according to claim 5, wherein the first supply state "dispenser almost empty" is transmitted when the remaining supply of dispenser material is less than 15%.

7. The hand towel dispenser according to claim 1, wherein the radio module comprises a microcontroller with which the used amount of dispenser material can be determined from the measured values captured by the measuring device.

8. The hand towel dispenser according to claim 1, wherein the hand towel dispenser comprises a protocol converter configured to receive data transmitted by the radio module and forward said data wirelessly to an external communication network.

9. The hand towel dispenser according to claim 8, wherein the protocol converter is a gateway that comprises a clock so that a forwarded radio signal also comprises, in addition to the at least one measured value, the time of its forwarding.

10. The hand towel dispenser according to claim 1, wherein a level indication representing a current amount of used dispenser material is transmitted in a periodically transmitted radio signal by the radio module.

11. The hand towel dispenser according to claim 1, wherein the radio module transmits a periodic signal that indicates that the radio module is in operation.

12. The hand towel dispenser according to claim 1, wherein the radio module transmits radio signals in a frequency range between 868 MHz and 870 MHz.

13. The hand towel dispenser according to claim 1, wherein a transmission time of a radio signal of the radio module is between 55 ms and 65 ms.

14. The hand towel dispenser according to claim 1, wherein a number of revolutions that the reel roll that winds up the used dispenser material carries out is captured by the measuring device.

15. The hand towel dispenser according to claim 1, wherein the drive roller is fastened on the reel shell and is configured to wind used dispenser material around a reel axis of the reel roll.

16. The hand towel dispenser according to claim 15, wherein the hand towel dispenser comprises a spring storage drive with which the drive roller is driven.

17. The hand towel dispenser according to claim 16, wherein a deflection roller is arranged on a housing of the hand towel dispenser and is driven during a winding off of dispenser material from the hand towel roll containing fresh dispenser material and by which the spring storage drive is pre-tensioned.

18. The hand towel dispenser according to claim 16, wherein the spring storage drive comprises a time-delay device that is activated during the winding off of dispenser material from the hand towel roll containing fresh dispenser material and after a course of a set time span activates the spring storage drive for drawing in the used dispenser material.

19. The hand towel dispenser according to claim 15, wherein the drive roller forms a rotatable frictional contact with the reel roll comprising the used dispenser material.

20. The hand towel dispenser according to claim 19, wherein the drive roller is provided with nubs on its jacket surface.

21. The hand towel dispenser according to claim 9, wherein the hand towel dispenser comprises a signal amplifier or signal preparer that is arranged between the radio module and the gateway.

22. The hand towel dispenser according to claim 1, wherein the radio module comprises a battery, and wherein a state of the battery is captured by the radio module and transmitted from the radio module as another data signal.

23. The hand towel dispenser according to claim 1, wherein the hand towel dispenser comprises a manual defect switch connected to the radio module so that upon actuation of the defect switch a message "dispenser defect" is transmitted by the radio module.

24. The hand towel dispenser according to claim 5, wherein the radio signals that comprise the supply states "dispenser almost empty" and "dispenser empty" can be transmitted in real time by the radio module.

25. The hand towel dispenser according to claim 1, wherein the radio signals transmitted by the radio module comprise an identification of the product dispenser.

26. The hand towel dispenser according to claim 1, wherein the radio signals transmitted by the radio module comprise a location of the product dispenser.

27. The hand towel dispenser according to claim 1, wherein the hand towel dispenser is connected to a central data processing system for data transmission via an external communication network via a gateway.

28. The hand towel dispenser according to claim 27, wherein the external communication network is a mobile telephone network and wherein the data transmission from the gateway to the central data processing system takes place via the mobile telephone network.

29. A kit for retrofitting a hand towel dispenser according to claim 1, comprising:

a first sensor, a second sensor and a third sensor;

a first magnet, a second magnet and a third magnet; and a gateway.

30. A method for monitoring and servicing a hand towel dispenser according to claim 27, wherein the method comprises the steps:

capturing a supply state "dispenser almost empty" or "dispenser empty" in at least one hand towel dispenser by the measuring device;

receiving a radio signal "dispenser almost empty" or "dispenser empty" transmitted from the radio module in real time by the protocol converter; and forwarding a received radio signal "dispenser almost empty" or "dispenser empty" together with an indication of a time of the transmission via the protocol converter by the external communication network to the central data processing system.

31. The method according to claim 30, further comprising the steps:

capturing the used amount of dispenser material on the winding-up reel roll by the measuring device;

forwarding the captured, used amount of dispenser material in a periodically transmitted radio signal from the radio module to the protocol converter;

forwarding the radio signal together with the indication of the time of the transmission from the protocol converter to the central data processing system;

storing the captured, used amount of dispenser material in a data memory of the central data processing system; and processing the detected amounts of dispenser material with the particular indications of time with the central data processing system to data concerning the frequency of use and the product consumption of the hand towel dispenser.

32. A method for retrofitting a hand towel dispenser such that it becomes a hand towel dispenser according to claim 1, comprising the steps:

replacing an original reel shell with a reel shell having a pre-assembled radio module; and incorporating magnets in the hand towel dispenser.

* * * * *